US011195491B2

(12) United States Patent
Choi et al.

(10) Patent No.: US 11,195,491 B2
(45) Date of Patent: Dec. 7, 2021

(54) POWER MANAGEMENT DEVICE TO MINIMIZE POWER CONSUMPTION

(71) Applicant: SILICON WORKS CO., LTD., Daejeon (KR)

(72) Inventors: Jung Min Choi, Daejeon (KR); Hong Kyu Choi, Daejeon (KR); Seong Sik Yoon, Daejeon (KR); Jung Hyun Tark, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 81 days.

(21) Appl. No.: 16/836,657

(22) Filed: Mar. 31, 2020

(65) Prior Publication Data

US 2020/0320953 A1 Oct. 8, 2020

(30) Foreign Application Priority Data

Apr. 5, 2019 (KR) ..... 10-2019-0040085
Mar. 5, 2020 (KR) ..... 10-2020-0027680

(51) Int. Cl.
*G09G 5/00* (2006.01)

(52) U.S. Cl.
CPC ..... *G09G 5/003* (2013.01); *G09G 2300/0871* (2013.01); *G09G 2330/021* (2013.01)

(58) Field of Classification Search
CPC ..... G09G 5/003; G09G 2300/0871; G09G 2330/021; G09G 3/20; G09G 2310/061; G09G 2330/022; G09G 2330/028
See application file for complete search history.

(56) References Cited

U.S. PATENT DOCUMENTS 7,034,816 B2 * 4/2006 Yatabe ..... G09G 3/3688 345/213
7,133,013 B2 * 11/2006 Kamezaki ..... G09G 3/3677 345/98
7,327,341 B2 * 2/2008 Toriumi ..... G09G 3/3648 345/212
8,253,721 B2 * 8/2012 Lee ..... G09G 3/3696 345/212
9,070,341 B2 6/2015 Ji et al.
9,207,785 B2 * 12/2015 Kim ..... G09G 3/003
9,582,066 B2 * 2/2017 Hong ..... G06F 1/3265
9,652,090 B2 * 5/2017 Tan ..... G06F 3/04162
9,922,613 B2 * 3/2018 Suyama ..... G09G 3/3677
9,922,614 B2 * 3/2018 Choi ..... G09G 3/3688
10,181,292 B2 * 1/2019 Jung ..... G09G 3/3291
10,198,064 B2 * 2/2019 Kwon ..... G06F 1/3296
10,775,931 B2 * 9/2020 Kim ..... G06F 3/044
2005/0206637 A1 * 9/2005 Takahashi ..... G09G 3/3688 345/204
2012/0001950 A1 * 1/2012 Kim ..... G09G 3/3291 345/690
2015/0325200 A1 * 11/2015 Rho ..... G09G 3/3688 345/212
2017/0004798 A1 * 1/2017 Park ..... G09G 3/3648

FOREIGN PATENT DOCUMENTS

JP 2019-124949 A 7/2019
KR 10-1653006 B 8/2016

* cited by examiner

*Primary Examiner* — Bryan Earles
(74) *Attorney, Agent, or Firm* — Fenwick & West LLP

(57) ABSTRACT

Power consumption of a display device is reduced by controlling power supplies in driving sections and in non-driving sections to be different.

18 Claims, 11 Drawing Sheets

POWER MANAGEMENT DEVICE TO MINIMIZE POWER CONSUMPTION

CROSS REFERENCE TO RELATED APPLICATION

This application claims priority from Republic of Korea Patent Applications No. 10-2019-0040085 filed on Apr. 5, 2019 and Republic of Korea Patent Application No. 10-2020-0027680 filed on Mar. 5, 2020, each of which are hereby incorporated by reference in its entirety.

BACKGROUND

1. Field of Technology

The present disclosure relates to a technology for controlling a power management device.

2. Description of the Prior Art

The most important issue regarding electronic devices including mobile devices is to minimize power consumption. As electronic devices become downsized and the capacity of a battery is limited, the power consumption needs to be reduced. For this reason, research into the minimization of power consumption is being done. Display devices comprised in almost all electronic devices may be a component where a considerable reduction of power consumption can be made.

A power management device known as a power management integrated circuit (PMIC) supplies power required for driving a display in an electronic device to devices such as a panel, a data driving device, a gate driving device, etc. Recently, as there are more display devices to which power does not need to be constantly supplied, for example, mobile communication devices, laptop computer devices, or the like, research into the minimization of power consumption using such power management devices is in progress.

In this regard, the present disclosure is to provide a technology for improving power consumption by partially reducing or interrupting a power supply while a display device operates.

SUMMARY

In this background, an aspect of the present disclosure is to provide a technology for reducing the amount of power consumption of a display device.

Another aspect of the present disclosure is to provide a technology for reducing the amount of power consumption of a display panel.

Still another aspect of the present disclosure is to provide a technology for reducing the amount of power consumption of a display driving device.

Still another aspect of the present disclosure is to provide a technology for reducing the amount of power consumption of a power management device.

To this end, an aspect of the present disclosure provides a power management device for managing power of a display device that operates by dividing each time frame into driving sections and non-driving sections, comprising: a voltage converting circuit to convert power received through a first terminal into voltages and to output the voltages through a second terminal; and a controlling circuit to control the voltage converting circuit such that the voltages of the second terminal are maintained at a constant level in each driving section and such that limited currents are output through the second terminal, the output through the second terminal is interrupted, or the voltages of the second terminal are reduced in a part or the whole of each non-driving section.

The power management device may comprise a communication circuit to receive time division signals to define the driving sections and the non-driving sections and the controlling circuit may control the voltage converting circuit to output the converted voltages in accordance with the time division signals.

In the power management device, the controlling circuit may control the voltage converting circuit such that the voltages of the second terminal are maintained at a constant level in a beginning part of each non-driving section.

In the power management device, the controlling circuit may control the voltage converting circuit such that the output of the second terminal is interrupted or the voltages of the second terminal are reduced after the beginning part of the non-driving section.

In the power management device, the controlling circuit may re-start the output of the converted voltages in a latter part of each non-driving section.

Another aspect of the present disclosure provides a display device comprising: a panel operated by a first driving voltage; a data driving device operated by a second driving voltage; and a power management device to maintain the first and the second driving voltage at a constant level in each driving section and to output the first and the second driving voltage with limited currents or to interrupt the output of the first and the second voltages in a part or the whole of each non-driving section.

The display device may further comprise a data processing device to transmit control signals for controlling the power management device.

In the display device, the control signals may comprise time division signals to define the driving sections and the non-driving sections or voltage control signals to control the first or the second voltages.

The display device may comprise a level shifter (LS) operated by a third driving voltage, and the power management device may maintain the third driving voltage at a constant level and output the third driving voltage to the level shifter in the driving sections, but output the ones of the first to the third driving voltages with limited currents or interrupt the output in the non-driving sections.

The display device may comprise a gate driving device operated by a fourth driving voltage, and the power management device may maintain the fourth driving voltage at a constant level and output the fourth driving voltages to the gate driving device in the driving sections, but output the ones of the first to the fourth driving voltages with limited currents or interrupt the output in the non-driving sections.

In the display device, the panel may comprise a gate driving device operated by the first driving voltage therein.

In the display device, the data driving device may be partially or entirely turned off in the non-driving sections.

In the display device, scan lines or data lines of the panel may be floated.

The display device may further comprise capacitors to supply less power than the power of the first driving voltage or the second driving voltage to the panel or the data driving device.

In the display device, the scan lines or the data lines of the panel may be floated in the beginning part of each non-driving section, and the power management device may maintain the output of the first and the second driving voltages in the beginning part.

In the display device, the data driving device may be partially or entirely turned off in the beginning part of each non-driving section, and the power management device may maintain the output of the first and the second driving voltages in the beginning part.

In the display device, the power management device may output the first and the second driving voltages in the latter part of each non-driving section.

In the display device, the data driving device may be initialized when each driving section starts after each non-driving section.

As described above, the present disclosure allows reducing the amount of power consumption of a display device, that of a display panel, that of a display driving device, and that of a power management device.

DETAILED DESCRIPTION

Figure 1:
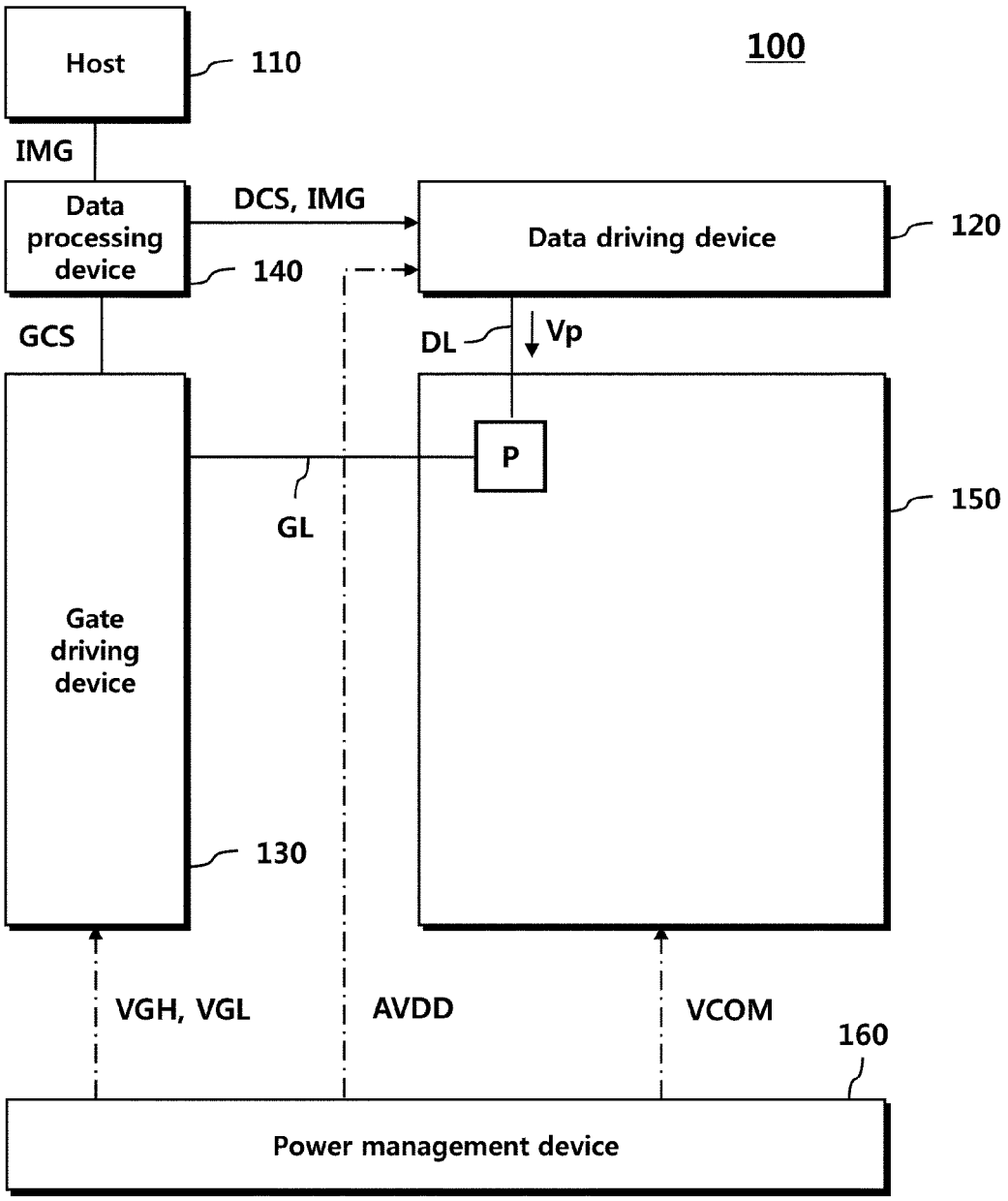
FIG. 1 is a configuration diagram of a display device according to an embodiment of the present disclosure.

FIG. 1 is a configuration diagram of a display device according to an embodiment of the present disclosure.

Referring to FIG. 1, a display device 100 may comprise a plurality of display driving devices 110, 120, 130, 140, 160, and a display panel 150.

On the display panel 150, a plurality of data lines DL and a plurality of gate lines GL may be disposed. In addition, a plurality of pixels P connected with the plurality of data lines DL and the plurality of gate lines GL may be disposed thereon.

The display driving devices 110, 120, 130, 140, 160 generate signals for displaying images on the display panel 150. A host 110, a data driving device 120, a gate driving device 130, a data processing device 140, and a power management device 160 may correspond to the display driving devices 110, 120, 130, 140, 160.

The gate driving device 130 may supply gate driving signals, such as turn-on voltages or turn-off voltages, through the gate lines GL. When a gate driving signal of a turn-on voltage is supplied to a pixel P, the pixel P is connected with a data line DL. When a gate driving signal of a turn-off voltage is supplied to a pixel P, the pixel P is disconnected from the data line DL. The gate driving device 130 may be referred to as a gate driver.

The data driving device 120 may supply a data voltage Vp to a pixel P through a data line DL. The data voltage Vp supplied through the data line DL may be supplied to the pixel P according to a gate driving signal. The data driving device 120 may be referred to as a source driver.

The data processing device 140 may supply control signals to the gate driving device 130 and the data driving device 120 and transmit image data IMG to the data driving device 120. For example, the data processing device 140 may transmit a gate control signal GCS making a scan to start to the gate driving device 130. In addition, the data processing device 140 may transmit a data control signal DSC for controlling the data driving device 120 to supply a data voltage Vp to each pixel P. The data processing device 140 may be referred to as a timing controller.

The host 110 may generate image data IMG and transmit it to the data processing device 140.

The power management device 160 may supply voltages (power) to various components in the display device. For example, the power management device 160 may supply common electrode voltages VCOM to the display panel 150. In addition, the power management device 160 may supply gate low voltages VGL and gate high voltages VGH to the gate driving device 130 and driving voltages AVDD to the data driving device 120.

The power management device 160 according to an embodiment may supply a plurality of voltages to the display panel 150, the gate driving device 130, and the data driving device 120 in driving sections of each time frame, whereas it may reduce or interrupt the supply of the plurality of voltages or supply them in a low current mode in a part or the whole of non-driving sections of each time frame. Here, a non-driving section may be a part of a time frame where the display driving devices 110, 120, 130, 140, 160 contributing to a display of image data IMG are driven at the minimum or not driven, while the image data IMG is consistently displayed on the panel 150. In such a way, the power management device 160 may minimize the amount of power consumption in the non-driving sections.

Figure 2:
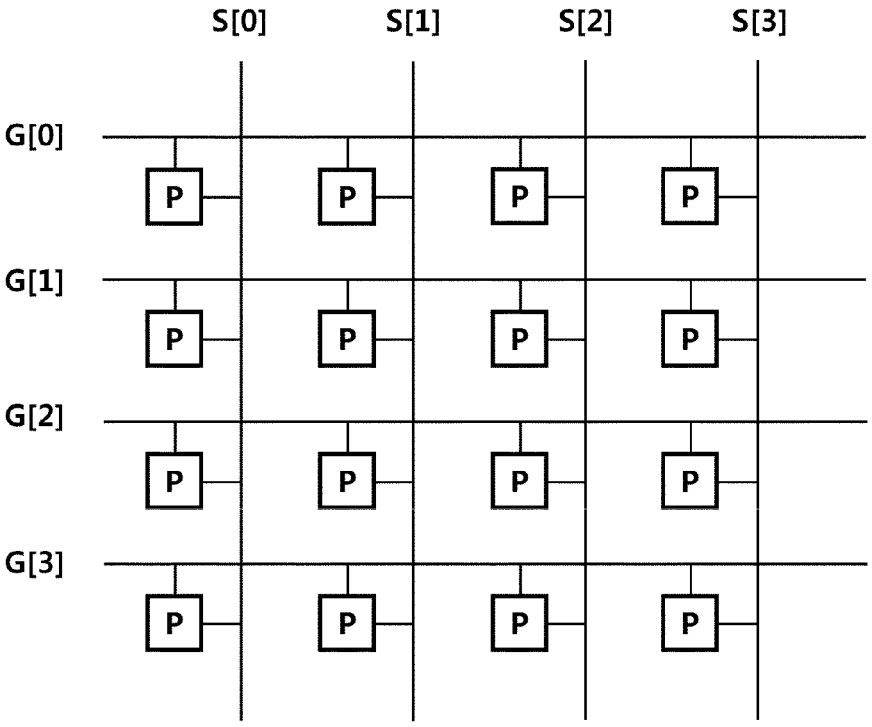
FIG. 2 is a diagram illustrating line arrangement of a display panel according to an embodiment of the present disclosure.

FIG. 2 is a diagram illustrating line arrangement of a display panel according to an embodiment of the present disclosure.

Referring to FIG. 2, on a panel, gate lines G[0]~G[3] are disposed in one direction and data lines S[0]~S[3] are disposed in a direction intersecting with the direction of the gate lines G[0]~G[3].

The intersections of the gate lines G[0]~G[3] with the data lines S[0]~S[3] define pixel areas and the pixels are disposed in these pixel areas.

Each pixel may be connected with the others through the data lines S[0]~S[3] and switches (not shown). The switches (not shown) may be controlled by gate driving signals supplied through the gate lines G[0]~G[3].

This embodiment may be applied to liquid crystal display (LCD) panels, organic light emitting diode (OLED) panels, plastic OLED (POLED) panels, mini LED panels, micro LED panels, or the like. This embodiment may be applied to a panel driven using gate lines and data lines in a form of matrix.

Figure 3:
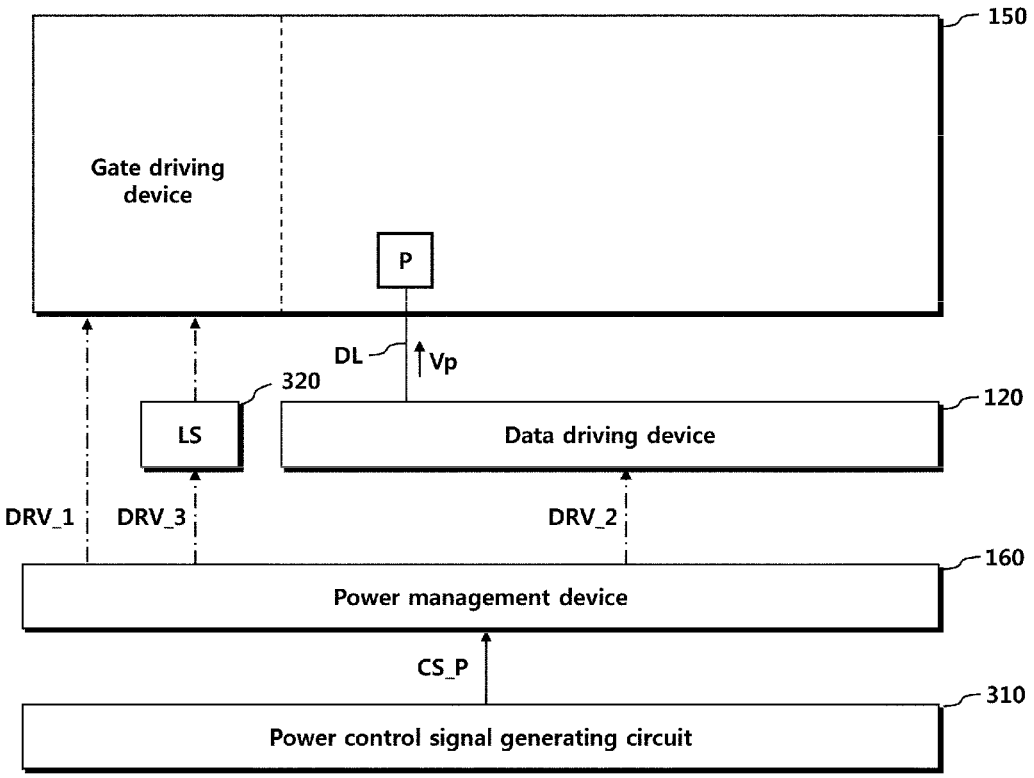
FIG. 3 is a first exemplary configuration diagram of a display device according to an embodiment of the present disclosure.
Figure 4:
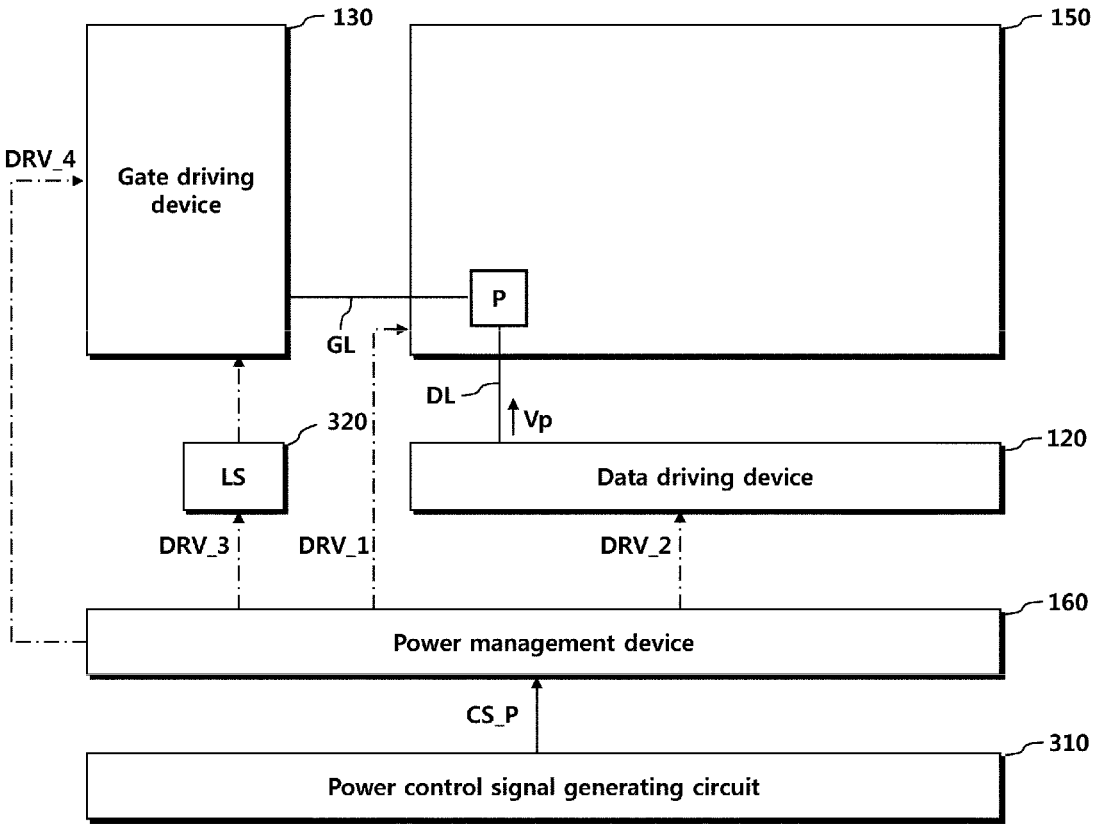
FIG. 4 is a second exemplary configuration diagram of a display device according to an embodiment of the present disclosure.

FIG. 3 is a first exemplary configuration diagram of a display device according to an embodiment of the present disclosure and FIG. 4 is a second exemplary configuration diagram of a display device according to an embodiment of the present disclosure.

Referring to FIG. 3, a gate driving device 130 may be implemented in a gate on array (GOA) method or in a gate in panel (GIP) method. When a gate driving device 130 is implemented in the GOA or GIP methods, the gate driving device 130 is integrated with the panel 150, and thus, is a part of the panel 150.

Referring to FIG. 4, a gate driving device 130 may be implemented as a gate integrated circuit (IC). When a gate driving device 130 is implemented as an IC, the gate driving device 130 may be disposed outside the panel 150 and connected with the panel 150 through the gate lines GL.

The gate driving device 130 may be operated by driving voltages received from the power management device 160. In a case when the gate driving device 130 is integrated with the panel 150 as shown FIG. 3, the gate driving device 130 may be operated by driving voltages for the panel 150. In a case when the gate driving device 130 is implemented as an IC, the gate driving device 130 may independently receive driving voltages from the power management device 160 and be operated by them.

A power control signal generating circuit 310 may generate power control signals CS_P for controlling the power management device 160 and transmit the signals to the power management device 160. The power control signals CS_P may include time division signals to define driving sections in which data voltages corresponding to image data are applied to the panel 150 and non-driving sections. In addition, the power control signals CS_P may include power control signals CS_P determining characteristics, such as sizes, periods, frequencies, or phases, of driving voltages supplied by the power management device 160.

The power control signal generating circuit 310 may be implemented as a separate control circuit such as a system on chip (SoC) or a main control unit (MCU). The power control signal generating circuit 310 may also be implemented as a timing controller (T-Con). In this case, the power control signal generating circuit 310 may be a data processing device (140 in FIG. 1).

The data driving device 120 may be implemented as a source driver IC, a source readout IC (SRIC: source IC+readout IC), a T-con embedded display (TED) IC, a touch display driving IC (TDDI), or the like.

The data driving device 120 may be operated by driving voltages received from the power management device 160.

The power management device 160 may supply power to the display driving devices 120, 130, 140, 150, 310. The power management device 160 may maintain a plurality of driving voltages at a constant level in the driving sections, and may output the plurality of driving voltages with limited currents or interrupt the output of the driving voltages in a part or the whole of the non-driving sections.

In addition, the power management device 160 may receive power from an external power source, convert the power into driving voltages respectively suitable for characteristics required by each of the display driving devices 120, 130, 150, 310, and output the driving voltages to the display driving devices 120, 130, 150, 310.

For example, the power management device 160 may generate various types of driving voltages. The driving voltages may include gate high voltages VGH, gate low voltages VGL, analogue driving voltages AVDD (analogue VDD), common electrode voltages VCOM, OLED pixel driving voltages ELVDD, ELVSS, or the like. The gate high voltages and the gate low voltages may be required for the gate driving device 130 to generate scan signals. The analogue driving voltages AVDD may be required for generating data voltages corresponding to image data. The common electrode voltages VCOM may be applied to common electrodes of the panel 150. The OLED pixel driving voltages ELVDD, ELVSS may be applied to OLEDs.

The power management device 160 may output first driving voltages DRV_1. For example, the power management device 160 may output a common electrode voltage VCOM to the panel, and may output a gate high voltage VGH together with a gate low voltage VGL to the gate driving device 130 in a case when the gate driving device 130 is integrated with the panel 150.

The power management device 160 may output a second driving voltage DRV_2. For example, the power management device 160 may output an analogue driving voltage AVDD to the data driving device 120.

The power management device 160 may output a third driving voltage DRV_3. For example, the power management device 160 may output a gate high voltage VGH and a gate low voltage VGL to a level shifter 320. The level shifter 320 may generate driving voltages suitable for various types of devices requiring different characteristics, such as the sizes, of driving voltages and transmit them respectively to the devices.

The power management device 160 may output a fourth driving voltage DRV_4. For example, the power management device 160 may output a gate high voltage VGH and a gate low voltage VGL to the gate driving device 130. Here, the gate driving device 130 may be implemented as a separate IC.

Furthermore, the power management device 160 may output driving voltages respectively to the display driving devices 120, 130, 150, 310 in the driving sections of a time frame, but output the driving voltages with limited currents or reduce or interrupt the voltages in the non-driving sections.

Figure 5:
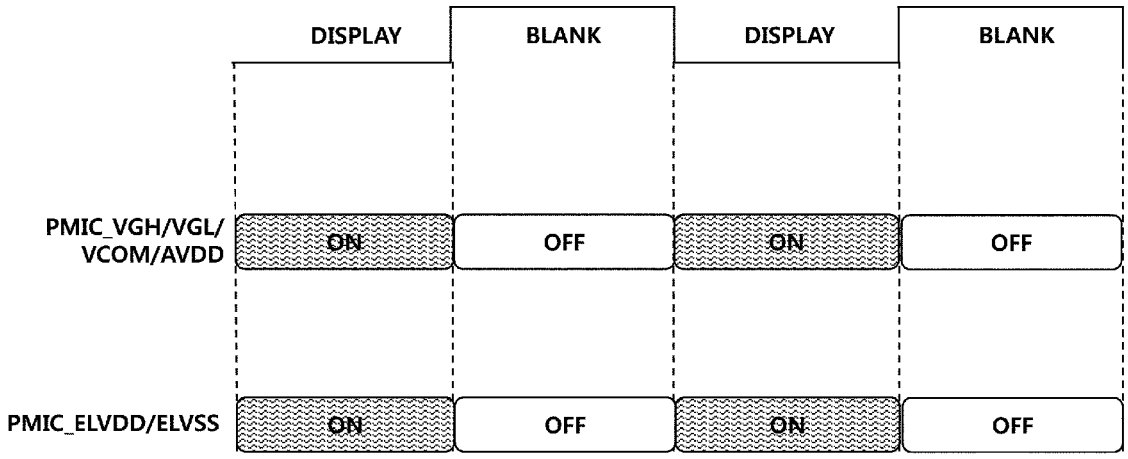
FIG. 5 is a timing diagram illustrating a display driving method according to an embodiment of the present disclosure.

FIG. 5 is a timing diagram illustrating a display driving method according to an embodiment of the present disclosure.

Referring to FIG. 5, each time frame may be divided into driving sections DISPLAY and non-driving sections BLANK.

In the driving sections, the brightness of each pixel of the display panel may be adjusted. For example, in the driving sections, the gate driving device may supply a gate driving signal through a gate line to connect a pixel with a data line and the data driving device may supply a data voltage through the data line to adjust the brightness of the pixel.

In the driving sections, the power management device may supply a plurality of voltages to the panel, the level shifter, the gate driving device, and the data driving device (PMIC_VGH/VGL/VCOM/AVDD in FIG. 5).

For example, in the driving sections, the power management device may output common electrode voltages VCOM to the panel and may output gate high voltages VGH together with gate low voltages VGL to the gate driving device in a case when the gate driving device is integrated with the panel. The power management device may output analogue driving voltages AVDD to the data driving device.

In the driving sections, the power management device may output gate high voltages VGH and gate low voltages VGL to the level shifter. In the driving sections, the power management device may output gate high voltages VGH and gate low voltages VGL to the gate driving device. In the driving sections, when the panel is an OLED panel, the power management device may supply OLED pixel driving voltages ELVDD, ELVSS to the panel.

In a part or the whole of the non-driving sections, the power management device may reduce or interrupt the plurality of driving voltages supplied to the panel, the level shifter, the gate driving device, and the data driving device or supply them in a low current mode (PMIC_ELVDD/ELVSS in FIG. 5).

Figure 6:
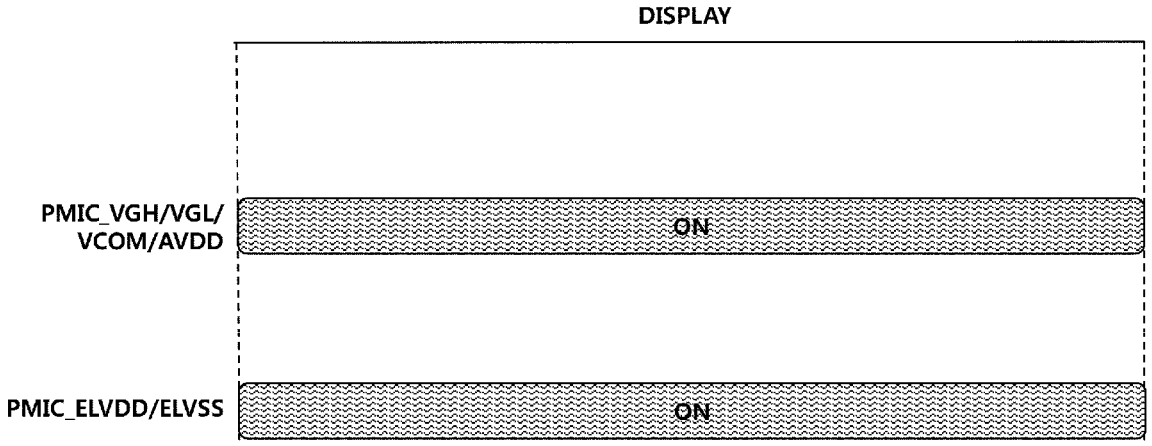
FIG. 6 is a diagram illustrating a general display driving method.

FIG. 6 is a diagram illustrating a general display driving method.

Referring to FIG. 6, according to a general display driving method, a display device may use an entire time frame as a driving section. That is, a time division operation in which a display operates only in predetermined sections may not be made. Here, the speed of transmitting or receiving image data, etc. may be relatively slow or the number of communication lines may be relatively small. In such a general display driving method, a power management device may continuously supply a plurality of driving voltages to a panel, a level shifter, a gate driving device, and a data driving device in an entire time frame.

For example, the power management device may continuously output gate high voltages VGH, gate low voltages VGL, common electrode voltages VCOM, and analogue driving voltages AVDD in an entire time frame (see PMIC_VGH/VGL/VCOM/AVDD in FIG. 6). In addition, the power management device may continuously output OLED pixel driving voltages ELVDD, ELVSS in an entire time frame (see PMIC_ELVDD/ELVSS in FIG. 6).

Figure 7:
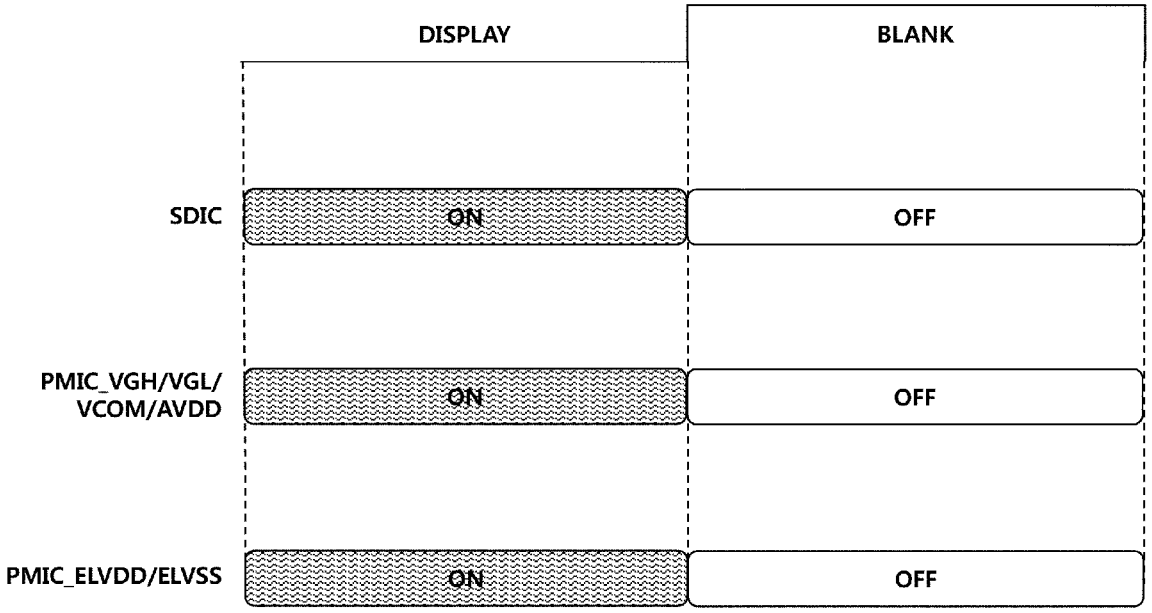
FIG. 7 is a diagram illustrating a display driving method according to an embodiment of the present disclosure.

FIG. 7 is a diagram illustrating a display driving method according to an embodiment of the present disclosure.

Referring to FIG. 7, in a display driving method according to an embodiment, one section (for example, a first half part) of a time frame may be assigned as a driving section DISPLAY and the other section (for example, a second half part) of the time frame may be assigned as a non-driving section BLANK in a display device.

Components of a display device, contributing to the output of image data may be enabled in the driving section, whereas the components may be disabled in the non-driving section. For example, in the non-driving section, a part or the whole of a data driving device, such as a source driver IC, may be turned off (see SDIC in FIG. 7). Here, a part of the source driver IC may be an analogue block for processing analogue data or a digital block for processing digital data.

In addition, the power management device may supply a plurality of driving voltages to the panel, the level shifter, the gate driving device, and the data driving device in the driving section, whereas it may reduce or interrupt the plurality of voltages supplied to the panel, level shifter, gate driving device, and data driving device, or supply them in a low current mode (see PMIC_VGH/VGL/VCOM/AVDD and PMIC_ELVDD/ELVSS in FIG. 7).

For example, the power management device may output gate high voltages VGH, gate low voltages (VGL), common electrode voltages VCOM, and analogue driving voltages AVDD in the driving sections, and reduce or interrupt the driving voltages or output the driving voltages with low currents in the non-driving sections. In addition, the power management device may output OLED pixel driving voltages ELVDD, ELVSS in the driving section, and reduce or interrupt these driving voltages or output them with low currents in the non-driving section.

In an embodiment, the display device may use high speed communication for shortening a driving section. Here, the speed of transmitting or receiving image data or the like may relatively be high. In addition, the number of communication lines may relatively be large.

Figure 8:
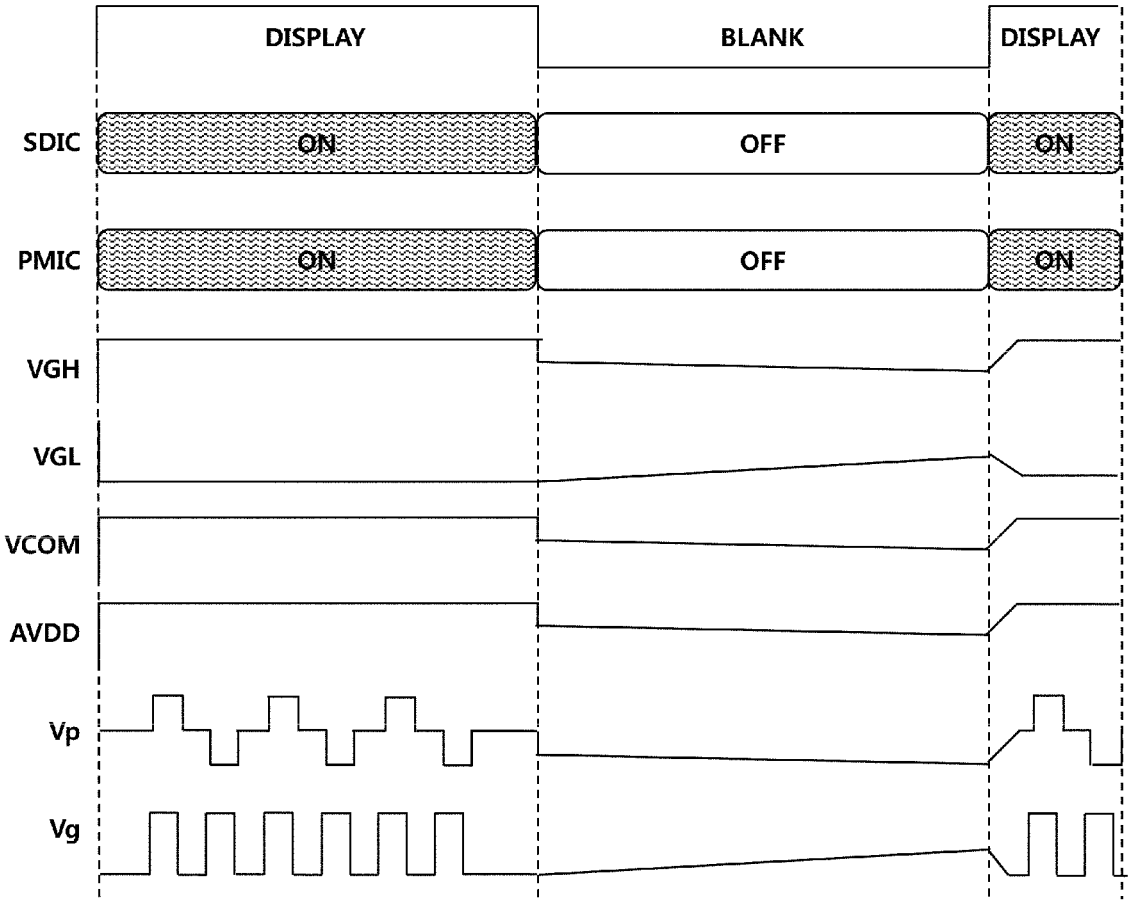
FIG. 8 is a diagram illustrating a first example of output controls of a power management device of a display driving method according to an embodiment of the present disclosure.
Figure 9:
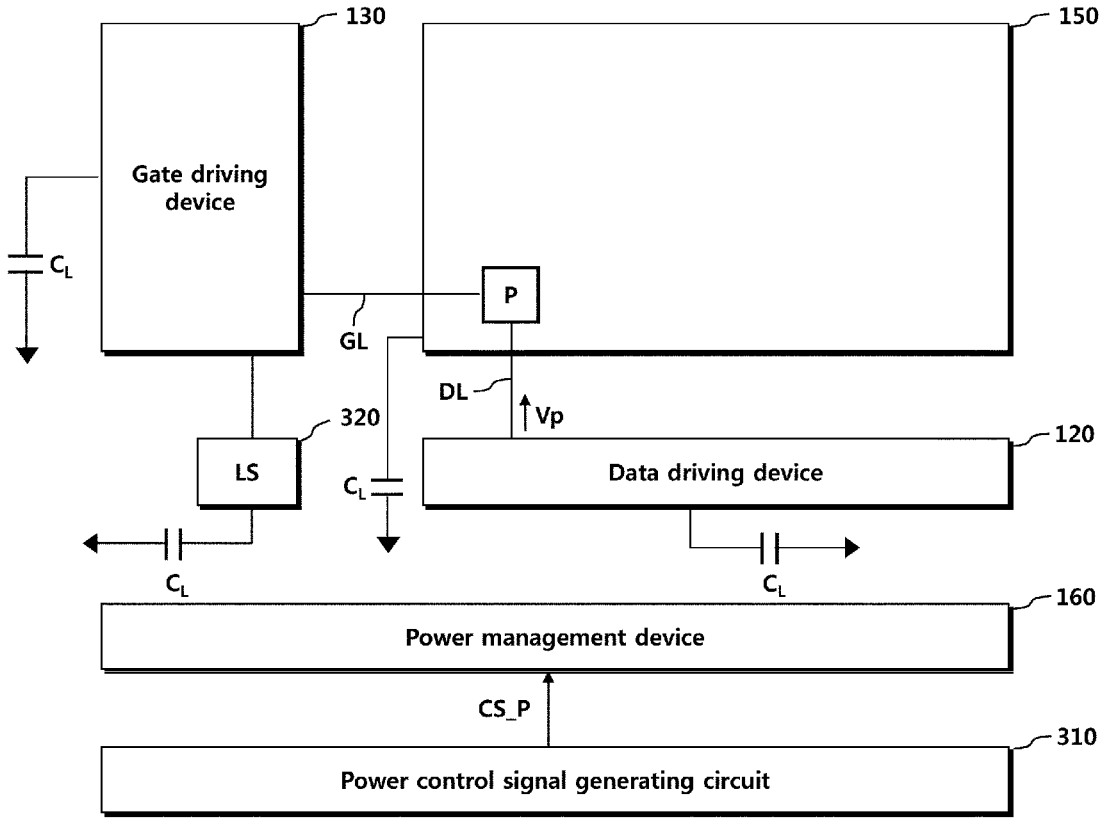
FIG. 9 is a diagram illustrating the connection of load capacitors according to an embodiment of the present disclosure.

FIG. 8 is a diagram illustrating a first example of output controls of a power management device of a display driving method according to an embodiment of the present disclosure and FIG. 9 is a diagram illustrating the connection of load capacitors according to an embodiment of the present disclosure.

Referring to FIG. 8, the power management device may supply a plurality of driving voltages VGH, VGL, VCOM, AVDD to the panel, the level shifter, the gate driving device, and the data driving device in driving sections (see ON of PMIC in FIG. 8).

For example, the power management device may output common electrode voltages to the panel and output gate high voltages together with gate low voltages to the gate driving device in a case when the gate driving device is integrated with the panel. The power management device may output analogue driving voltages AVDD to the data driving device. The power management device may output gate high voltages VGH and gate low voltages VGL to the level shifter. Or, the power management device may output gate high voltages VGH and gate low voltages VGL to the gate driving device. Here, the gate driving device may be implemented as a separate IC.

In this case, the gate high voltages VGH, common electrode voltages VCOM, and analogue driving voltages AVDD may be maintained at a high level and the gate low voltages VGL may be maintained at a low level.

In the driving sections, data voltages Vp and gate driving signals Vg may also be generated as the plurality of driving voltages VGH, VGL, VCOM, AVDD. That is, the data voltages Vp may be supplied through the data lines and the gate driving signals Vg may be supplied through the gate lines in the driving sections. The data driving device may generate data voltages Vp from the analogue driving voltages AVDD. The gate driving device may generate gate driving signals Vg from the gate high voltages VGH and the gate low voltages VGL.

On the other hand, the power management device may reduce or interrupt the plurality of driving voltages VGH, VGL, VCOM, AVDD or output the voltages with low currents (see OFF of PMIC in FIG. 8) in the non-driving sections. For this, the display driving devices may be turned off or voltages of the display driving devices may be floated. For example, an analogue block of a data driving device such as a source driver IC may be turned off, voltages in the data lines may be floated due to the data lines being disconnected from the data driving device, or voltages in the gate lines may be floated due to the gate lines being disconnected from the gate driving device.

Or, in the non-driving sections, the power management device may be disconnected from parts where the plurality of driving voltages VGH, VGL, VCOM, AVDD are formed so that the plurality of driving voltages VGH, VGL, VCOM, AVDD may be floated in those parts. For example, when a communication line connecting the power management device and the gate driving device is disconnected from them, the voltages in the disconnected part are floated and the supply of gate high voltages and gate low voltages may be interrupted.

However, even though the plurality of driving voltages VGH, VGL, VCOM, AVDD are floated, their supply may not be completely interrupted. Load capacitors may be connected to the display driving devices receiving the plurality of driving voltages VGH, VGL, VCOM, AVDD and the load capacitors may supply small power to the display driving devices in the non-driving sections. The load capacitors may be charged by the plurality of driving voltages VGH, VGL, VCOM, AVDD in the driving sections, but may be discharged and supply less power to the display driving devices when the display driving devices are disconnected from the power management device in the non-driving sections. Here, the load capacitors may supply direct current power.

For this reason, in the non-driving sections, the gate high voltages VGH, gate low voltages VGL, common electrode voltages VCOM, and analogue driving voltages AVDD may be maintained at an almost constant level without being completely changed. For example, in the non-driving sections, the gate high voltages VGH, common electrode voltages VCOM, and analogue driving voltages AVDD may be maintained at a constant level, which is a middle one, without completely dropping. Since the load capacitors supply less power than the power management device, the level may descend with a gradual inclination. The gate low voltages VGL may increase to a middle level, and then, be maintained at a constant level. Since the load capacitors supply less power than the power management device, the level may rise gradually.

The gate high voltages VGH, gate low voltages VGL, common electrode voltages VCOM, and analogue driving voltages AVDD may be maintained at an almost constant level in each non-driving section and return to their original levels when a subsequent driving section starts. For example, the levels of the gate high voltages VGH, common electrode voltages VCOM, and analogue driving voltages AVDD may descend in each non-driving section, and ascend to the original ones when a subsequent driving section starts. The level of the gate low voltages VGL may ascend in each non-driving section, and descend to the original one when a subsequent driving section starts.

Referring to FIG. 9, load capacitors $C_L$ may be connected with the display driving devices 120, 130, 150, 320 to supply direct current power to them in the non-driving sections. In the driving sections, the power management device 160 may supply the first driving voltage (DRV_1 in FIG. 4), the second driving voltage (DRV_2 in FIG. 4), the third driving voltage (DRV_3 in FIG. 4), and the fourth driving voltage (DRV_4 in FIG. 4) to the display driving devices 120, 130, 150, 320 respectively through power lines. However, when the connection of the power lines is lost or the first to the fourth driving voltages (DRV_1 to DRV_4 in FIG. 4) are floated, the load capacitors $C_L$ may be connected with the display driving devices 120, 130, 150, 320 to supply direct current power to them.

Returning to FIG. 8, in the non-driving sections, the data voltages Vp and the gate driving signals Vg as well may be maintained at a constant level, which is a middle one, without completely dropping as the plurality of driving voltages VGH, VGL, VCOM, AVDD. Since the load capacitors $C_L$ supply less power than the power management device to the display driving devices, the level may descend or ascend gradually. The levels of the data driving voltages Vp and the gate driving signals Vg that descend in the non-driving sections may ascend to the original ones when a subsequent driving sections start.

Figure 10:
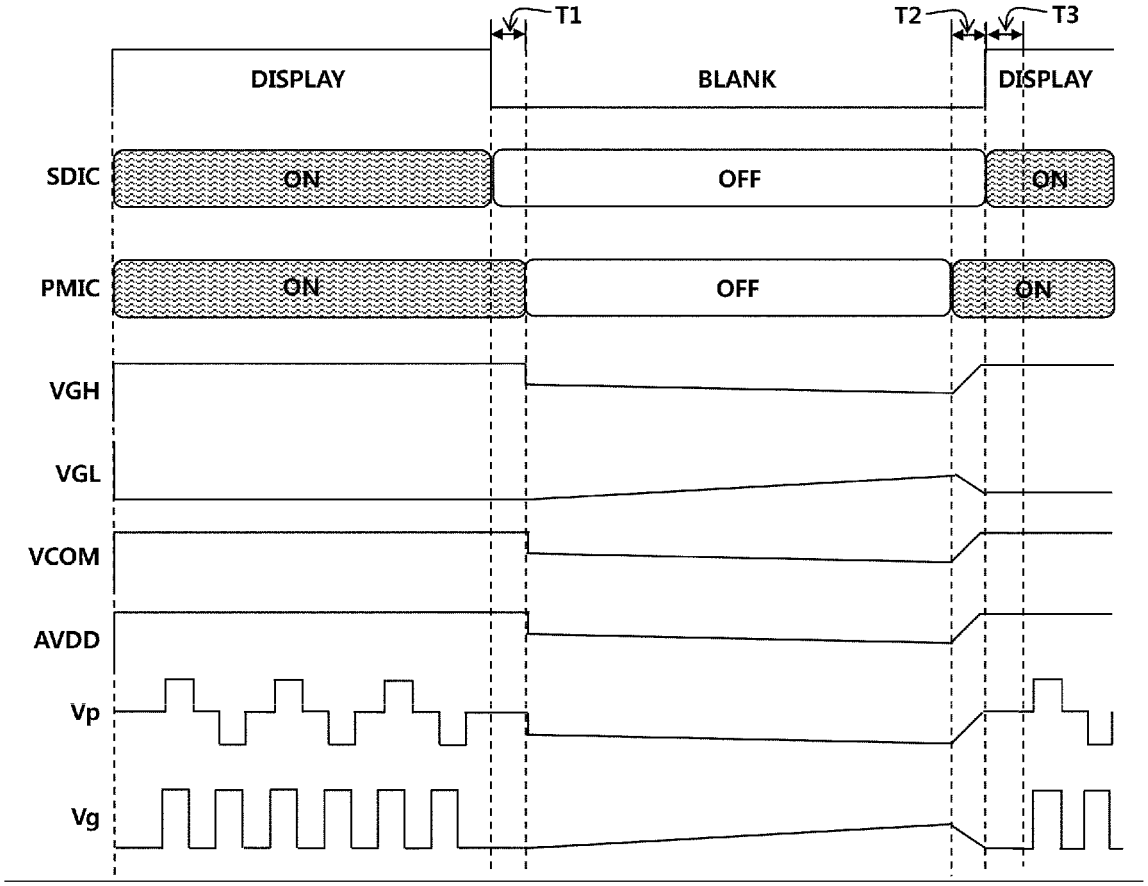
FIG. 10 is a diagram illustrating a second example of output controls of a power management device of a display driving method according to an embodiment of the present disclosure.

FIG. 10 is a diagram illustrating a second example of output controls of a power management device of a display driving method according to an embodiment of the present disclosure.

Referring to FIG. 10, a timing when the data driving devices are turned off and a timing when the power management device reduces or interrupts driving voltages or outputs them with low currents between a driving section and a non-driving section may be different.

First, in a beginning part T1 of a non-driving section, a data driving device such as a source driver IC SDIC and a gate driving device such as a gate driver IC may be turned off (see OFF of SDIC in FIG. 10). In this section, even though the source driver IC SDIC or the gate driver IC are turned off, a power management device such as a power management IC PMIC may still supply driving voltages (see ON of PMIC in FIG. 10). Accordingly, gate high voltages VGH, gate low voltages VGL, common electrode voltages VCOM, and analogue driving voltages AVDD may be maintained at a normal level in a subsequent driving section. In the subsequent driving section, data voltages Vp may also be supplied through the data lines and gate driving signals Vg may also be supplied through the gate lines.

If a data driving device, a gate driving device, or a panel are first turned off when a non-driving section starts after a driving section, the power management device becomes in a no-load state so that the change of power may stably be realized.

Otherwise, between the beginning part T1 of each non-driving section and a latter part T2 thereof, the data driving device may be turned off and the power management may reduce or interrupt the driving voltages or output them with low currents (see ON of SDIC and ON of PMIC in FIG. 10). In this section, the plurality of driving voltages VGH, VGL, VCOM, AVDD, the data voltages Vp, and the gate driving signals Vg may be maintained at a constant level by receiving less power from the load capacitors.

In the latter part T2 of each non-driving section, a power management device such as a power management IC PMIC may start to supply driving voltages (see ON of PMIC in FIG. 10). In this section, the source driver IC SDIC or the gate driver IC may still be turned off (see OFF of SDIC in FIG. 10). Accordingly, the gate high voltages VGH, gate low voltages VGL, common electrode voltages VCOM, analogue driving voltages AVDD, data voltages Vp, and gate driving signals Vg may be changed from floating state levels to their original levels in the non-driving sections.

If the power management device is first turned on when a driving section starts after a non-driving section, the power may stably be supplied to the display driving devices.

In a beginning part T3 of each driving section, a data driving device such as a source driver IC SDIC may subsequently be turned on (see ON of SDIC and ON of PMIC in FIG. 10). The data driving device may be initialized for a display operation. When being initialized, the data driving device may be connected with a data processing device in communication and perform a clock training, a link training, or the like. The gate high voltages VGH, gate low voltages VGL, common electrode voltages VCOM, analogue driving voltages AVDD, data voltages Vp, and gate driving signals Vg may stably be supplied.

According to such an embodiment, the power consumption may be reduced by interrupting a portion of the power or minimizing power in the non-driving sections of each time frame.

Figure 11:
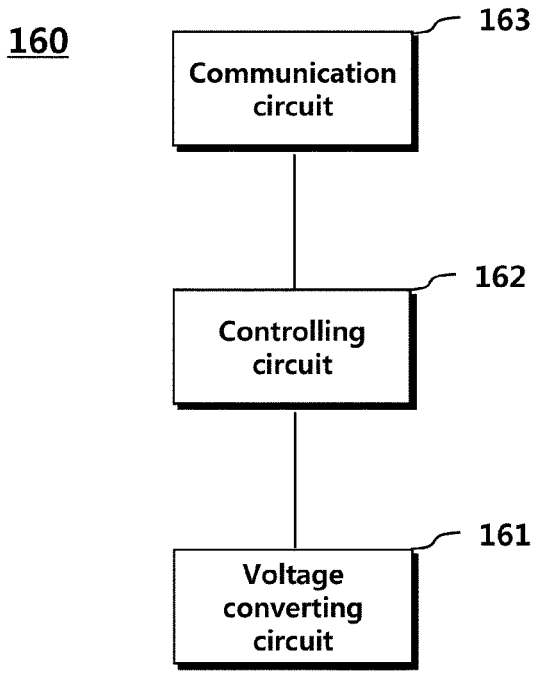
FIG. 11 is a configuration diagram of a power management device according to an embodiment of the present disclosure.

FIG. 11 is a configuration diagram of a power management device according to an embodiment of the present disclosure.

Referring to FIG. 11, the power management device 160 may comprise a voltage converting circuit 161, a controlling circuit 162, and a communication circuit 163. The power management device 160 may be included in a display device operated by dividing each time frame into driving sections and non-driving sections, and supply driving voltages to the panel, the gate driving device, the data driving device, the data processing device, and the level shifter. In the non-driving sections, the power management device 160 may reduce or interrupt the driving voltages or output them with low currents.

The voltage converting circuit 161 may receive base power from outside. The base power may be converted into driving voltages to be supplied respectively to circuits inside the display device. The voltage converting circuit 161 may receive the base power through a first terminal and convert it into the driving voltages to output them through a second terminal.

The voltage converting circuit 161 may convert the base power into the driving voltages having characteristics respectively suitable for the circuits inside the display device. For example, driving voltages having a level of 3.3V or 5V may be generated and transferred to a display driving circuit.

The voltage converting circuit 161 may transfer driving voltages to the internal devices of the display device.

The controlling circuit 162 may control the voltage converting circuit 161 such that the driving voltages of the second terminal are maintained at a constant level in the driving sections. The controlling circuit 162 may output the driving voltages of the second terminal in a limited current mode or reduce or interrupt the output of the driving voltages in the non-driving sections. Here, limited currents or low currents may mean currents lower than the currents required for outputting driving voltages in the driving sections. Lowering currents instead of voltages allows lowering the power consumption as well.

In the driving sections, the display device may turn on display driving circuits, for example, a panel, a gate driving circuit, a data driving circuit, and a data processing circuit. In the non-driving sections, the display device may turn off the display driving circuits. In the driving sections, the display device may float driving voltages by disconnecting scan lines, data lines, or power lines from the display device.

The communication circuit 163 may receive power control signals (CS_P in FIG. 3). The power control signals (CS_P in FIG. 3) as well may include time division signals to define the driving sections and the non-driving sections and voltage control signals to control the characteristics of the driving signals.

The controlling circuit 162 may supply driving voltages in a timing different from the timing of transition between a driving section and a non-driving section.

For example, the controlling circuit 162 may maintain an output level of driving voltages in the beginning part of each non-driving section, whereas the controlling circuit 162 may reduce or interrupt the driving voltages, or output them with low currents between the beginning part and the latter part of each non-driving section. In addition, the controlling circuit 162 may output normal driving voltages in the latter part of each non-driving section. The normal driving voltages may mean the driving voltages output in the driving sections.

What is claimed is:

1. A power management device operated by dividing each time frame into driving sections and non-driving sections, comprising:

a voltage converting circuit to convert power received through a first terminal into voltages and output the voltages through a second terminal; and a controlling circuit to control the voltage converting circuit such that the voltages of the second terminal are maintained at a constant level in each driving section and such that limited currents are output through the second terminal, the output of the second terminal is interrupted, or the voltages of the second terminal is reduced in a part of each non-driving section or each non-driving section in its entirety.

2. The power management device of claim 1, further comprising:

a communication circuit to receive time division signals to define the driving sections and the non-driving sections, wherein the controlling circuit controls the voltage converting circuit to output the voltages converted from the power according to the time division signals.

3. The power management device of claim 1, wherein the controlling circuit controls the voltage converting circuit such that the voltages of the second terminal are maintained at a constant level in a beginning part of each non-driving section.

4. The power management device of claim 3, wherein the controlling circuit controls the voltage converting circuit such that the output of the second terminal is interrupted or the voltages of the second terminal are reduced after the beginning part of each non-driving section.

5. The power management device of claim 1, wherein the controlling circuit re-starts the output of the voltages converted from the power in a latter part of each non-driving section.

6. A display device comprising:

a panel operated by first driving voltages;

a data driving device operated by second driving voltages; and a power management device to maintain the first driving voltage and the second driving voltage at a constant level in each driving section, and to output the first driving voltage and the second driving voltage with limited currents or to interrupt the output of the first driving voltage and the second driving voltage in a part of each non-driving section or an entirety of each non-driving section.

7. The display device of claim 6, further comprising:

a data processing device to transmit control signals for controlling the power management device.

8. The display device of claim 7, wherein the control signals include time division signals to define the driving sections and the non-driving sections or power control signals to control the first driving voltage and the second driving voltage.

9. The display device of claim 6, further comprising:

a level shifter operated by a third driving voltage, wherein the power management device maintains the third driving voltage at a constant level and outputs the third driving voltage to the level shifter in each driving section, whereas the power management device outputs one of the first driving voltage, the second driving voltage, or the third driving voltages in a limited current mode or interrupts the output thereof in each non-driving sections.

10. The display device of claim 9, further comprising:

a gate driving device operated by a fourth driving voltage, wherein the power management device maintains the fourth driving voltage at a constant level and outputs the fourth driving voltage to the gate driving device in each driving sections, whereas the power management device outputs one of the first driving voltage, the second driving voltage, the third driving voltage, or to the fourth driving voltage in a limited current mode or interrupts the output thereof in each non-driving section.

11. The display device of claim 6, wherein the panel includes a gate driving device operated by the first driving voltages therein.

12. The display device of claim 6, wherein the data driving device is partially or entirely turned off in the non-driving section.

13. The display device of claim 6, wherein scan lines or data lines of the panel are floated.

14. The display device of claim 6, further comprising:

capacitors to provide power less than the power of the first driving voltage or the second driving voltage to the panel or the data driving device.

15. The display device of claim 6, wherein scan lines or data lines of the panel are floated in a beginning part of each non-driving section and the power management device maintains the output of the first driving voltage and the second driving voltage in the beginning part.

16. The display device of claim 6, wherein the data driving device is partially or entirely turned off in a beginning part of each non-driving section and the power management device maintains the output of the first driving voltage and the second driving voltage in the beginning part.

17. The display device of claim 6, wherein the power management device outputs the first driving voltage and the second driving voltage in a latter part of the non-driving section.

18. The display device of claim 17, wherein the data driving device is initialized when each driving section starts after each non-driving section.

* * * * *